US005988938A

United States Patent [19]

Allen

[11] Patent Number: 5,988,938

[45] Date of Patent: Nov. 23, 1999

[54] COMPARTMENTALIZED ACCESS SHROUD SYSTEM FOR RIDING TROWELS

[75] Inventor: J. Dewayne Allen, Paragould, Ark.

[73] Assignee: Allen Engineering Corporation, Paragould, Ark.

[21] Appl. No.: 08/997,399

[22] Filed: Dec. 23, 1997

[51] Int. Cl.[6] ..... E01C 19/22

[52] U.S. Cl. ..... 404/112

[58] Field of Search ..... 404/112

[56] References Cited

U.S. PATENT DOCUMENTS

| | | | |
|---|---|---|---|
| D. 323,510 | 1/1992 | Allen et al. | D15/10 |
| 2,208,801 | 7/1940 | Mincher et al. | 404/112 |
| 2,654,298 | 10/1953 | Ytterberg | 404/112 |
| 2,754,733 | 7/1956 | Beyer | 404/112 |
| 2,869,442 | 1/1959 | Mincher | 404/112 |
| 3,936,212 | 2/1976 | Holtz, Sr. et al. | 404/112 |
| 4,046,484 | 9/1977 | Holtz, Sr. et al. | 404/112 |
| 4,312,603 | 1/1982 | Whiteman, Jr. | 404/112 |
| 4,556,339 | 12/1985 | Morrison | 404/112 |
| 4,676,691 | 6/1987 | Morrison | 404/112 |
| 4,710,055 | 12/1987 | Masses et al. | 404/112 |
| 5,108,220 | 4/1992 | Allen et al. | 404/112 |
| 5,480,257 | 1/1996 | Allen | 404/112 |
| 5,480,258 | 1/1996 | Allen | 404/112 |
| 5,613,801 | 3/1997 | Allen | 404/112 |
| 5,685,667 | 11/1997 | Allen | 404/112 |
| 5,816,739 | 10/1998 | Allen | 404/112 |

*Primary Examiner*—Thomas B. Will
*Assistant Examiner*—Raymond W Addie
*Attorney, Agent, or Firm*—Stephen D. Carver

[57] ABSTRACT

A powered riding trowel comprises a pair of releasable, protective, quick access hoods that may be unlatched to quickly expose the power means for service without structural disassembly. In a preferred embodiment, the twin hoods are hinged to the frame. The trowel seat is mounted on an upper planar surface of a releasable shroud disposed between the hoods. The shroud front and rear are preferably removably latched to the frame. Major portions of the shroud and the hoods are formed from rigid, supportive material having airflow pathways for cooling and ventilating the normally protected trowel interior. In an alternative embodiment both hoods are releasably coupled to the frame by spring biased latches.

12 Claims, 9 Drawing Sheets

COMPARTMENTALIZED ACCESS SHROUD SYSTEM FOR RIDING TROWELS

BACKGROUND OF THE INVENTION

I. Field of the Invention

The present invention relates generally to motorized concrete finishing trowels. More particularly, the present invention relates to motor powered riding trowels of the type classified in United States Patent Class 404, Subclass 112.

II. Description of the Prior Art

It has long been recognized by those skilled in the art that freshly placed concrete must be appropriately finished. Motorized riding trowels can fine finish plastic concrete on very large floor jobs soon after pouring. Motorized riding trowels have proven themselves in the industry. Their effectiveness for quickly and efficiently finishing large surfaces of wet concrete with either revolving blades or pans is undeniable, and such trowels are rapidly becoming the industry standard.

A typical power riding trowel comprises two or more bladed rotors that project downwardly and frictionally contact the concrete surface for finishing. These rotors are driven by one or more self contained motors mounted on the frame. The motors are linked to rotor gearboxes to revolve the rotors. The riding trowel operator sits on top of the frame and controls trowel movement with a steering system that tilts the axis of rotation of the rotors. The weight of the trowel and the operator is transmitted frictionally to the concrete by the revolving blades. The unbalanced frictional forces caused by rotor tilting enable the trowel to be steered.

As freshly poured concrete "sets," it soon becomes hard enough to support the weight of the specialized finishing trowel. While concrete is still "green" (i.e., within one to several hours after pouring depending upon the concrete mixture involved), power trowel pan finishing is required. Soon after panning, trowelling with power blades may begin as the slab adequately hardens. Numerous concrete finishing machines are known in the art for these purposes. Proper and timely finishing insures that desired surface characteristics including smoothness and flatness are achieved.

Power riding trowels should be passed over the surface being treated several times as the concrete sets. It is recommended that finishing pans be used first, when the concrete is relatively green, to achieve "super-flat" and "super-smooth" floors. The advent of more stringent concrete surface finish specifications using "F" numbers to specify flatness (ff) and levelness (fl), dictates the use of pans on a widespread basis. Pan finishing is normally followed by high speed blade finishing, after the pans are removed from the rotor blades. The trowel blades are adjusted to a relatively high pitch angle, and they directly frictionally contact the concrete surface. Rotors operate at high speed, in excess of one hundred-fifty RPM or more, resulting in a smooth, slick surface. High power riding trowels that quickly and efficiently finish large surfaces of wet concrete with either revolving blades or pans are rapidly becoming the industry standard.

Holz, in U.S. Pat. No. 4,046,484 shows a twin rotor riding trowel. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation.

Allen Engineering Corporation Pat. No. 5,613,801 issued Mar. 25, 1997 discloses a power riding trowel equipped with twin motors. The latter design employs a separate motor to power each rotor. Steering is accomplished with structure similar to that depicted in U.S. Pat. No. 5,108,220 previously discussed.

Allen U.S. Pat. No. 5,480,257 depicts a twin engine powered riding trowel whose guard structure is equipped with an obstruction clearance system. When troweling areas characterized by projecting hazards such as pipes or ducts, or when it is necessary to trowel hard-to-reach areas adjacent walls or the like, the guard clearance structure may be retracted to apply the blades closer to the target region.

Allen U.S. Pat. No. 5,685,667 depicts a twin engine riding trowel using "contra rotation." For enhanced stability and steering, the rotors rotate in a direction opposite from that normally expected in the art.

Although large, high power trowels are respected for their speed, horsepower, and efficiency, there are other considerations that deserve attention. For example, modem high power trowels require periodic maintenance and inspection. Easy access to critical parts is desirable. Downtime can be minimized by proper design that eases mechanical service requirements. Those parts that are most likely to require service from time to time should be easily accessed. At the same time, ease of access should not denigrate safety consideration. Very hot parts, for example, should be shrouded properly to prevent bums. (And adequate airflow must be established for proper cooling.) Besides service efficiency, operator comfort must be a paramount design goal.

With extremely large pours, troweling (i.e., panning) may begin soon after placement, continuing to late in the evening. Very large jobs may require two or more riding trowels, as critical finishing should ideally be completed before the concrete reaches a predetermined hardness. Thus the work hours may be long, and operator comfort must be insured. While operating a typical riding trowel the operator is obviously exposed to vibration, noises, and heat. The operator needs a comfortable, adjustable seat. Ideally, the seat is readily accessible to the controls. Further, the seat, and the platform mounting the seat, should be designed to dissipate the considerable heat generated by the high power trowel engines. In multiple engine designs airflow and cooling considerations are even more important. An ideal arrangement is obtained by combining the operator seat supporting structure with a ventilation pathway capable of readily dissipating engine exhaust heat. While the support structure preserves operator comfort and promotes safety, it may be relatively quickly released and deflected out-of-the way to expose critical trowel parts for service.

SUMMARY OF THE INVENTION

My new seating and shrouding system is ideal for multi-engine riding trowels, "stretch" trowels and other non-overlapping trowels. The preferred trowel comprises a pair of spaced apart engines secured near the frame ends. These engines drive conventional bladed rotors. Each motor is releasably covered by a protective hood that may be quickly deflected away to expose the motor for service.

A protective shroud is mounted in the middle of the frame between the hoods. When desired, portions of the shroud are simply unlatched and quickly displaced to expose various machine parts without machine disassembly. The preferred shroud thus functions cooperatively with the hoods. In the best mode of the invention known to me at this time, each hood end is hinged to the frame and the opposite end is selectively latched. In an alternative embodiment both hoods ends are releasably latched to the frame.

A basic object is to provide a comfortable, ergonomic seating and shroud system for use with multiple engine riding trowels.

Another important object is to provide a shroud system of the character described that is ideal for use with widened or "stretch" type power riding trowels.

A further object is to maximize operator comfort.

It is a fundamental object to keep the operator's hands away from critical moving parts.

A related object is to normally block operator access to any hot parts that may produce burns.

Another object is to provide an ergonomically optimized seating support in a power riding trowel.

Another object is to provide a quick access hood or shroud system for power riding trowels that may be easily displaced to an out-of-the way position for trowel service.

Another basic object is to maximize ease of service.

A further object is to combine a seating support of the character described with a properly ventilated shroud so that the considerable heat developed during power troweling can be comfortably dissipated.

A related object is to develop an air path that efficiently directs exhaust heat away from the operator seat.

An object of the present invention is to provide a serviceable riding trowel that is capable of quick adjustment.

A related object is to provide a comfortable trowel for panning or blading operations.

An object of the present invention is to provide a riding trowel that increases production and operator efficiency.

Another basic object is to provide a high speed, multiple rotor trowel that efficiently dissipates heat with maximum operator comfort.

It is also an object to provide a high power riding trowel that comfortably finishes concrete for long hours.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 8:
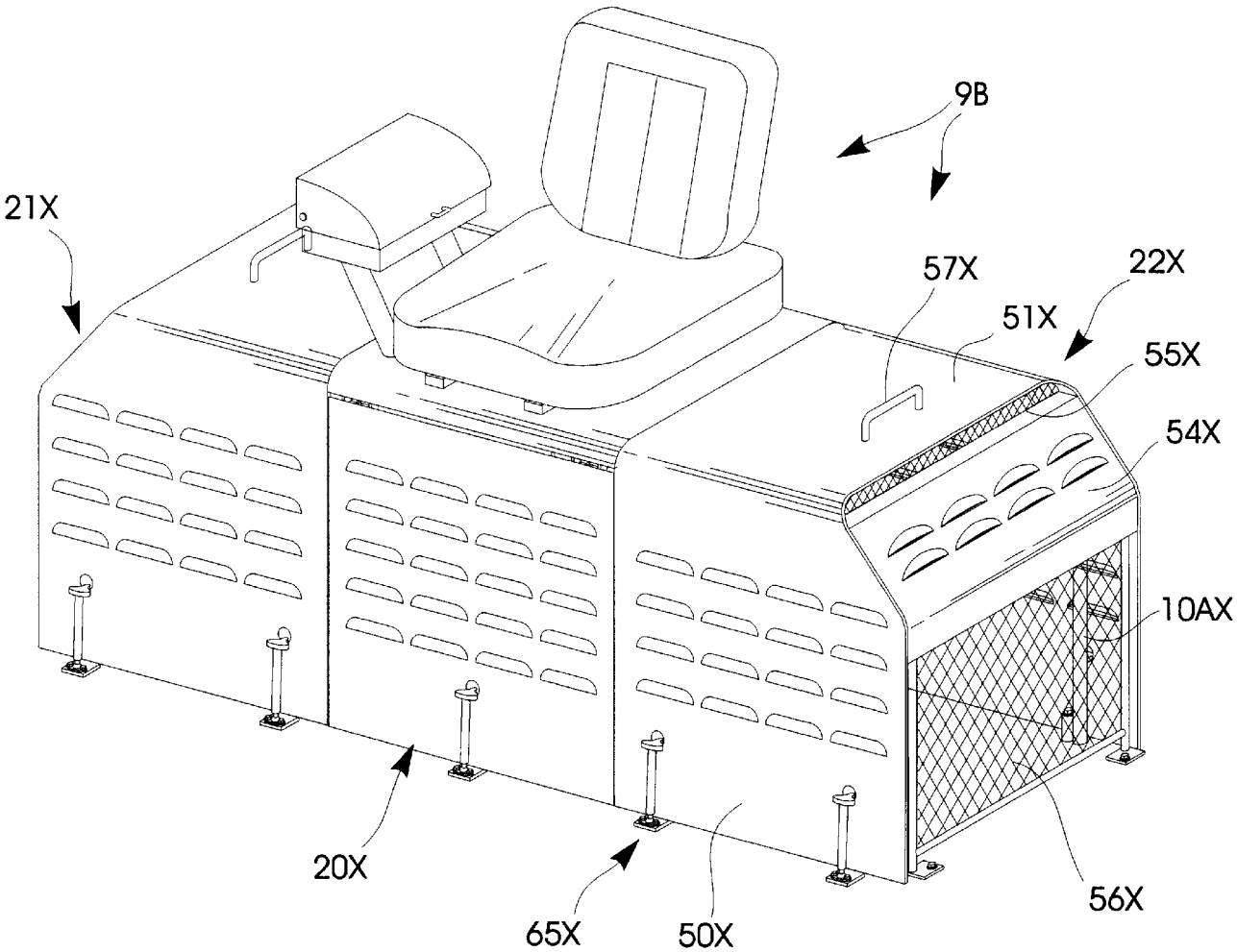
FIG. 8 is a fragmentary, front isometric view of an alternative riding trowel, with portions omitted for clarity.
Figure 9:
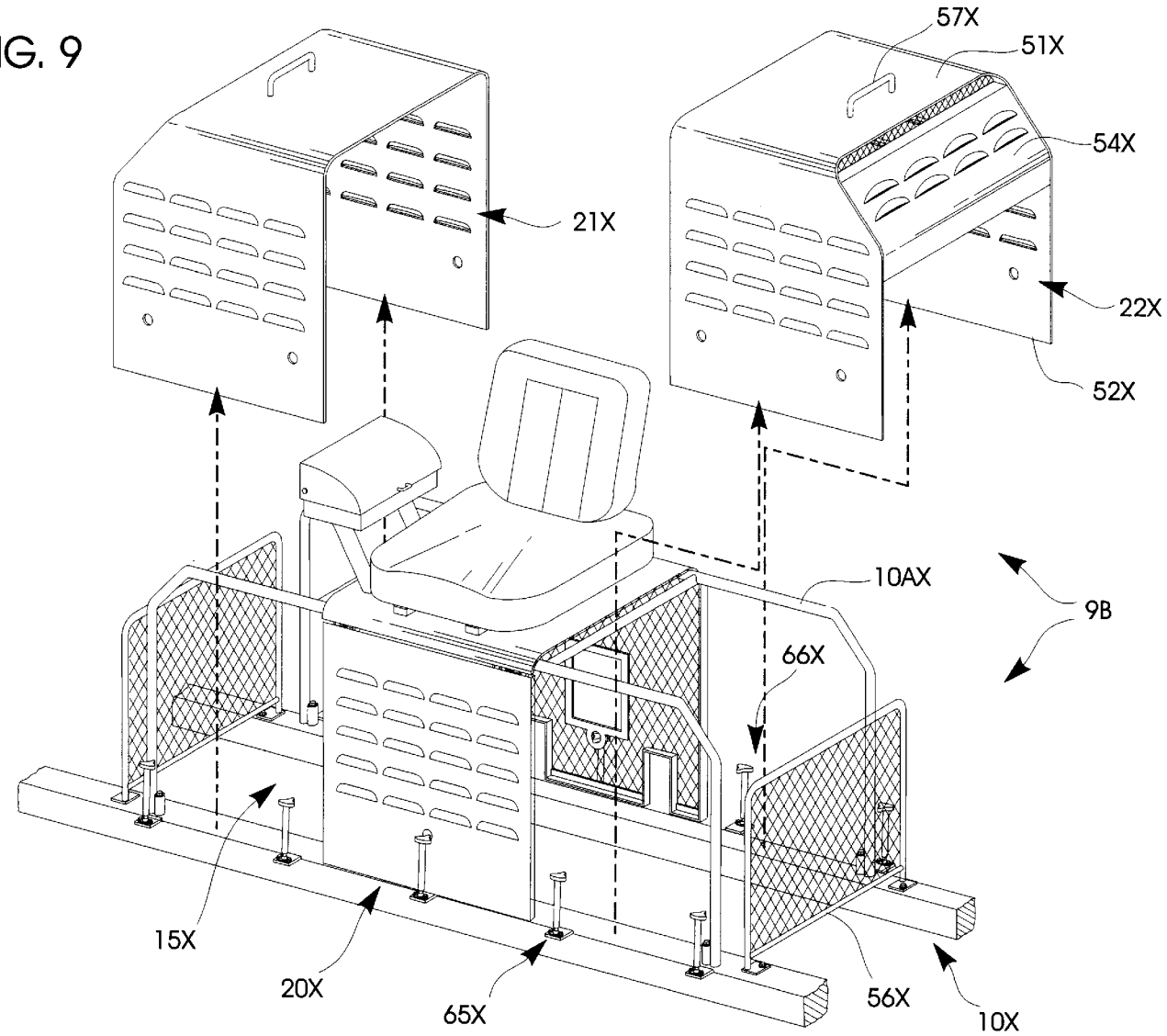
FIG. 9 is a fragmentary, partially exploded front isometric view showing the end hoods displaced away, with portions shown in section or omitted for clarity; and, FIG. 10 is a fragmentary, front elevational view of the alternative trowel and shroud system, showing the end hoods displaced away, with portions omitted for clarity.
Figure 10:
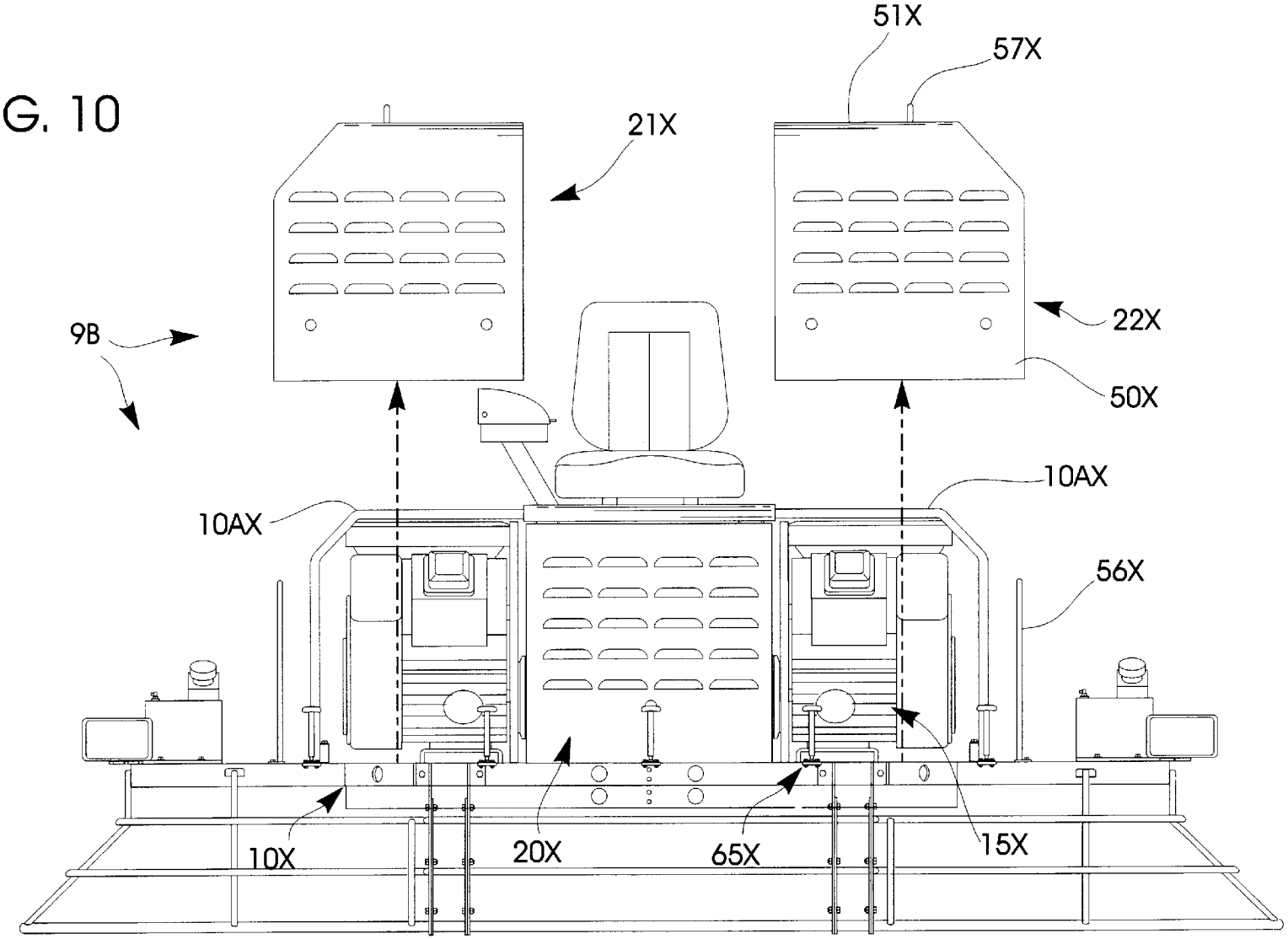

The preferred powered riding trowel 9A is seen in FIGS. 1–7, and an alternative trowel 9B is depicted in FIGS. 8–10. Common structural details relating to riding trowel motors, rotors, steering, rotor tilting, steering linkages, rotor configuration, blade construction and the like are set forth in prior U.S. Pat. Nos. 5,108, 220, 5,613,801, 5,480,257, and 5,685,667, all owned by Allen Engineering Corporation. For disclosure purposes, the aforementioned Allen patents, and the previously described Holz patents, U.S. Pat. Nos. 4,046, 484 and 3,936,212, are hereby incorporated by reference.

As explained in detail in one or more of the last mentioned patent references, each riding trowel comprises one or more engines for powering downwardly projecting, bladed rotors that frictionally contact the concrete. The steering system may include a plurality of both manual and hydraulic linkages and actuators. By tilting the rotors appropriately, directional steering forces are developed. In the embodiments described herein a protective cage 14 (i.e., FIGS. 3, 4) mounted to the frame guards the revolving rotor blades. The operator's seat 16 is mounted above the frame 10 upon a supportive shroud 20 to be described in detail hereinafter. A control panel 13 that houses one or more electrical indicators or controls is freely accessible from the seat. The steering actuators may comprise manually operated levers, as described in the above patents, that are accessible at the front of the trowel.

I. Best Mode

Figure 2:
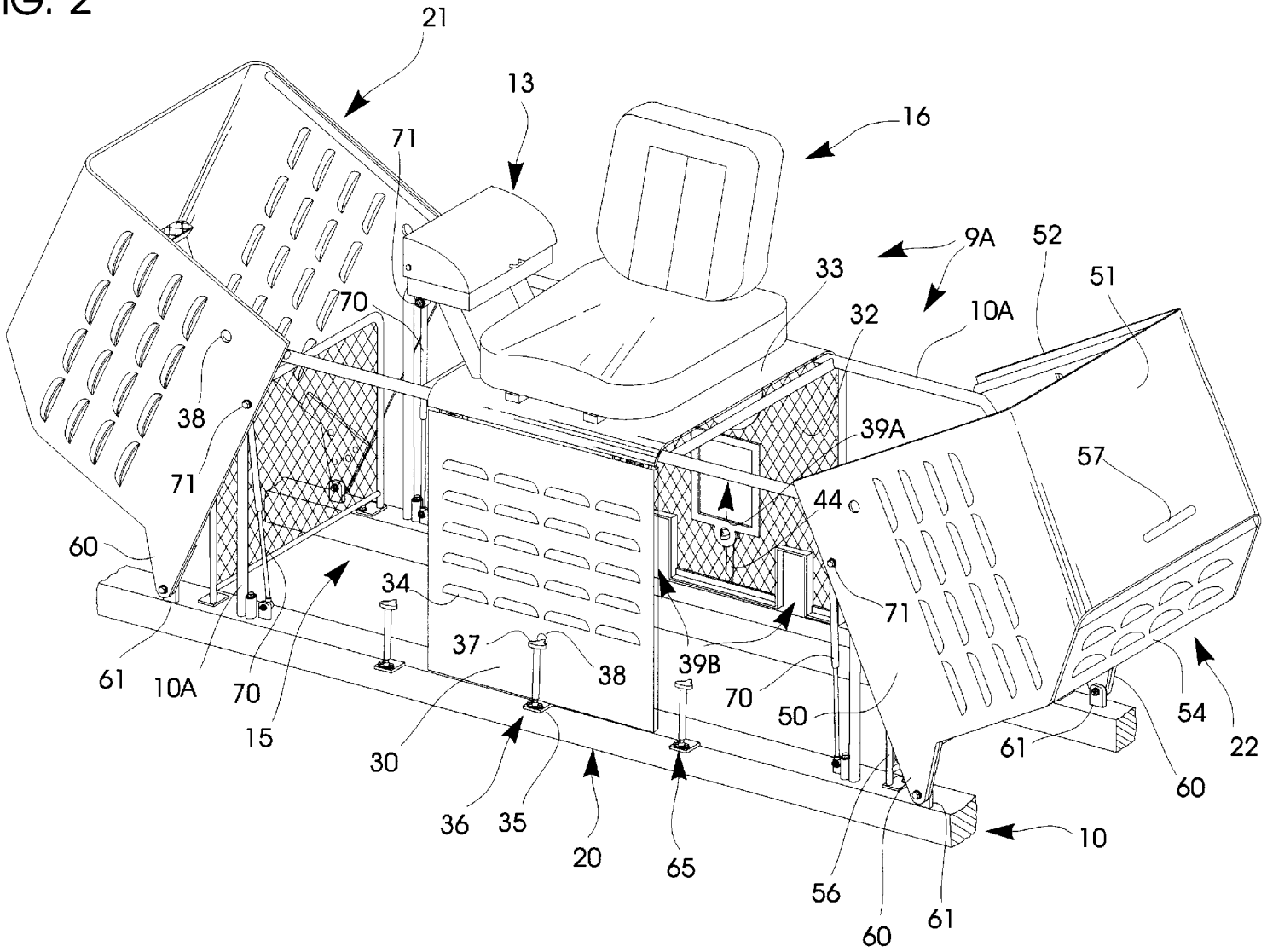
FIG. 2 is a fragmentary, front isometric view showing the hoods displaced away from the motor compartments, with portions shown in section or omitted for clarity.
Figures 3, 3A:
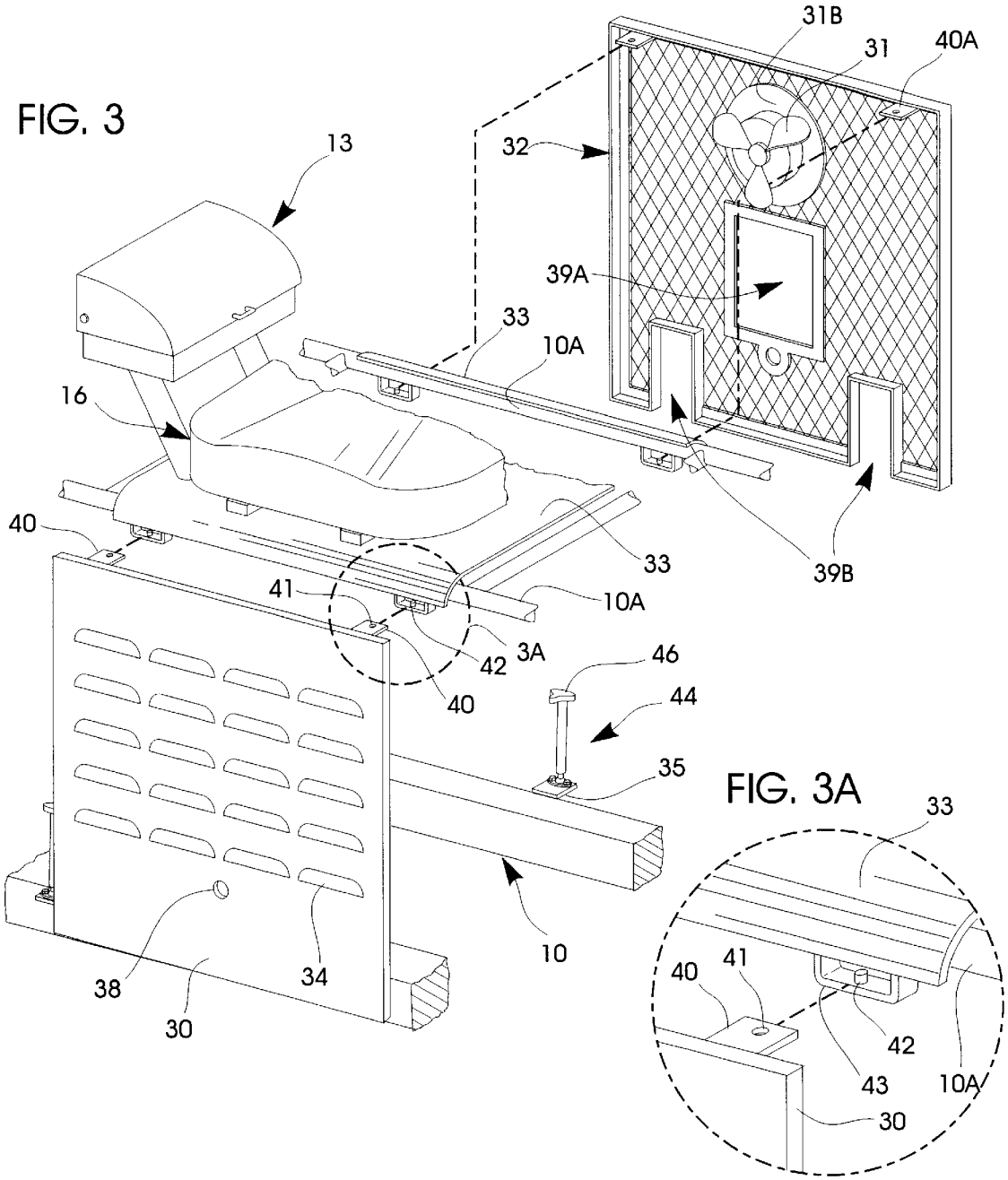
FIG. 3 is an enlarged fragmentary, partially exploded isometric view of the preferred shroud assembly, with portions thereof broken away or shown in section for clarity.
FIG. 3A is an enlarged, fragmentary isometric view of circled region 3A in FIG. 3.
Figure 4:
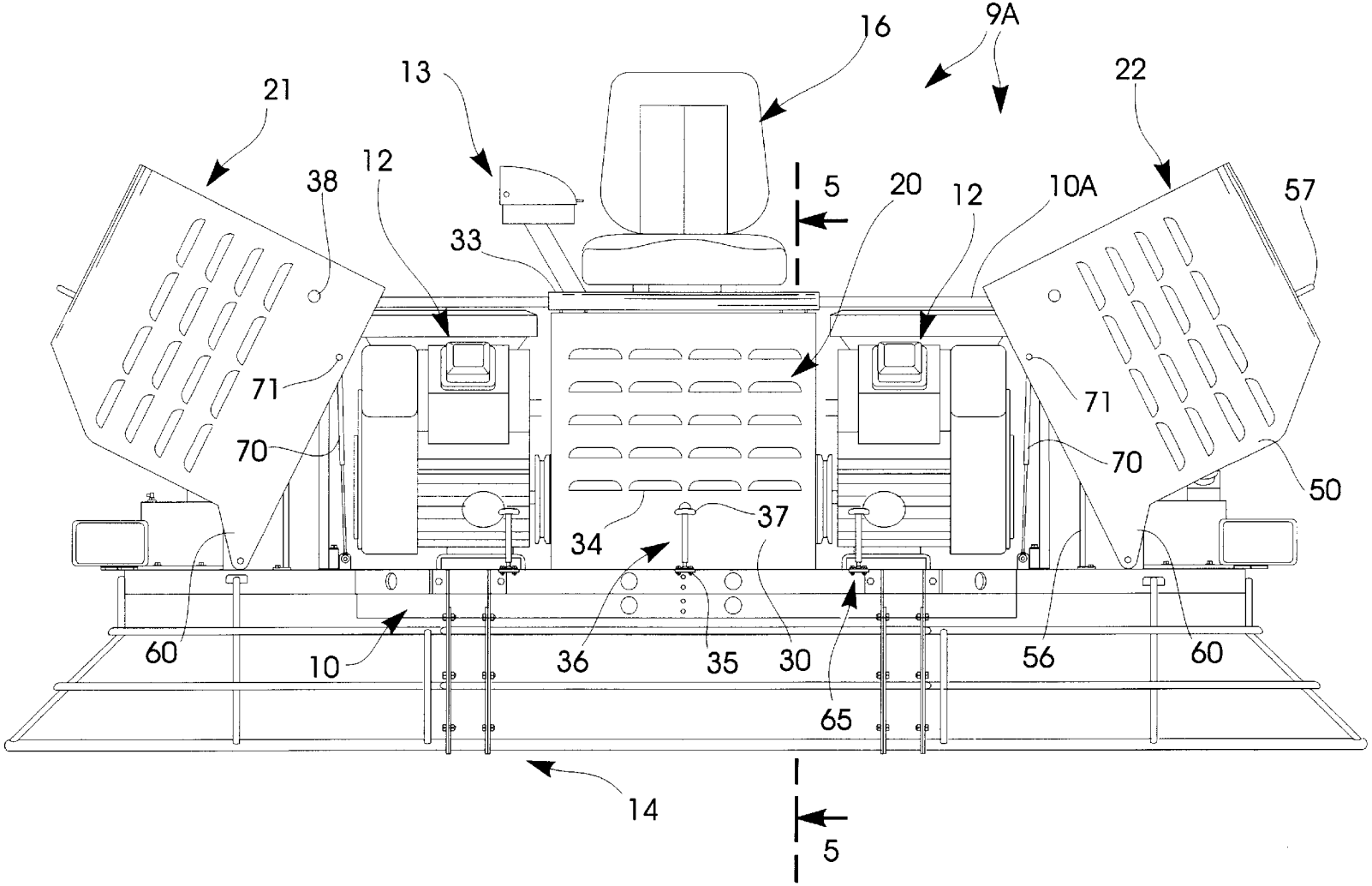
FIG. 4 is a fragmentary, front elevational view of the preferred trowel, showing the end hoods displaced away, with portions omitted for clarity.
Figure 5:
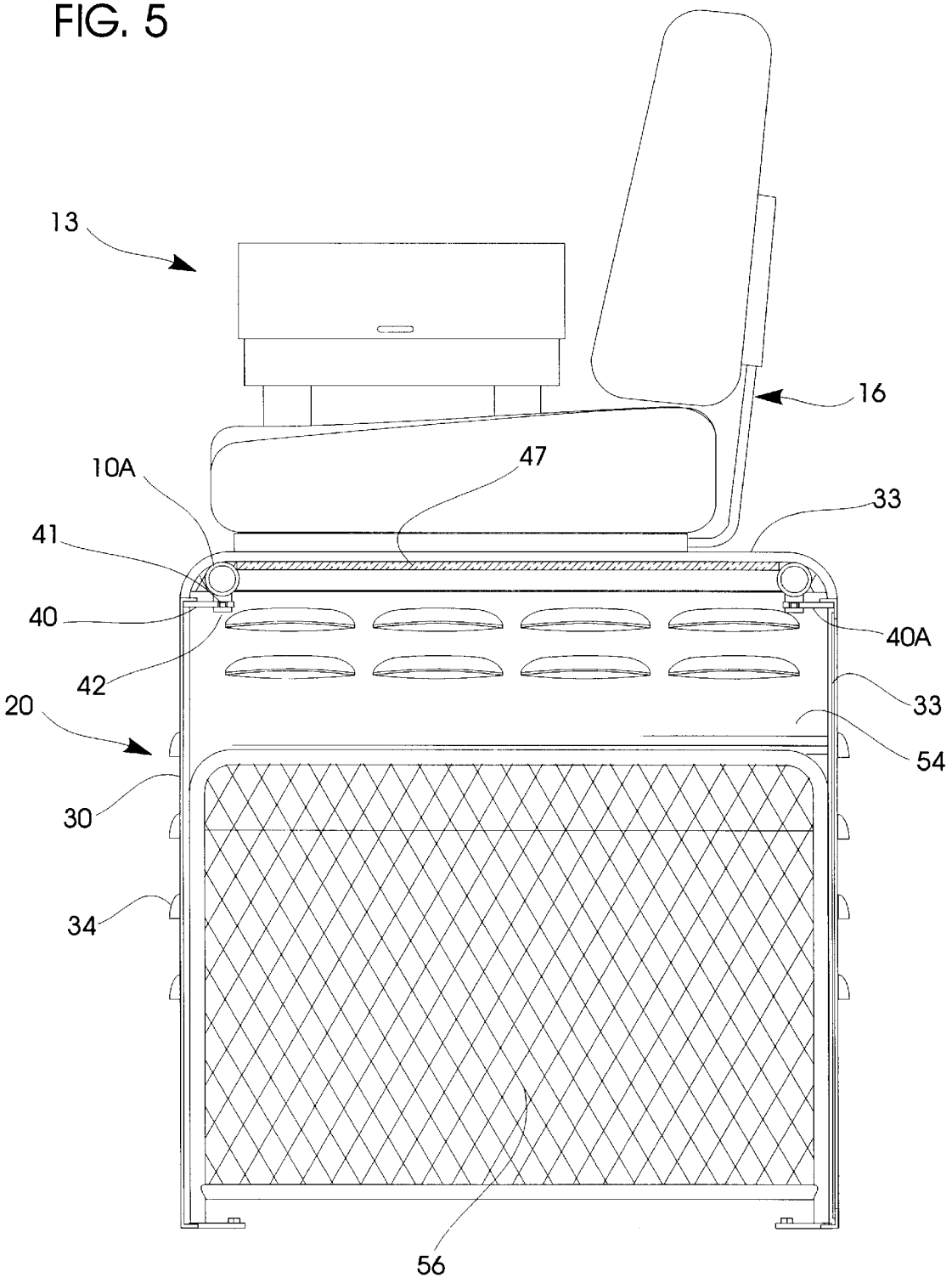
FIG. 5 is an enlarged, fragmentary transverse sectional view taken generally along line 5—5 of FIG. 1 with portions omitted for clarity.
Figure 6:
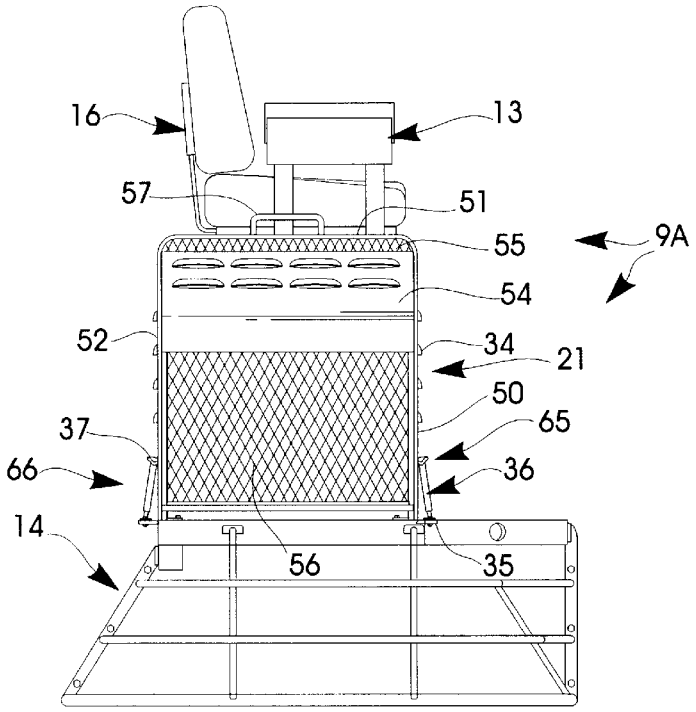
FIG. 6 is a right side elevational view.
Figure 7:
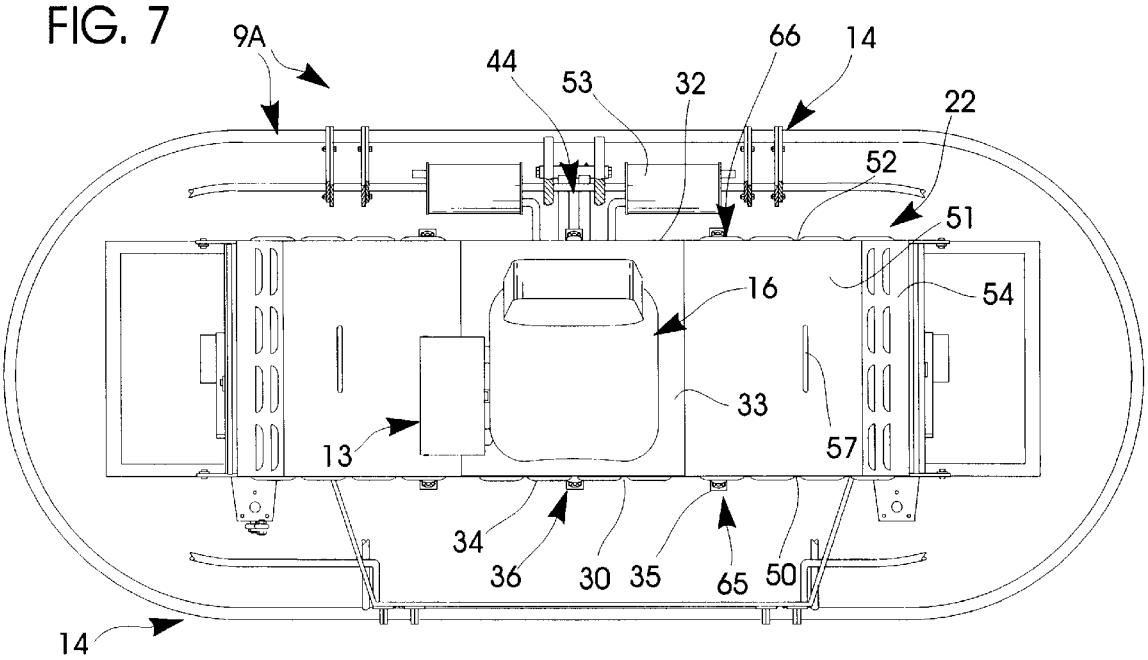
FIG. 7 is a fragmentary top plan view with portions omitted for clarity.

With initial attention now directed to the drawing FIGS. 1–7, trowel 9A comprises a frame 10 that supports lower cage 14 (FIGS. 4–6). Frame 10 comprises an upper subframe 10A that is generally in the form of a parallelepiped. A large, engine-surrounding volume 15 is enclosed by subframe 10A, shroud 20 and deflectable hoods 21, 22. Typical internal combustion engines 12, illustrated in FIG. 4, are shrouded by hoods 21, 22 within volume 15. Importantly, the engine mufflers are located externally of region 15. Shroud 20 encloses an optional water spray system and the trowel battery etc., not shown. It will be understood that engines 12 power the rotors (not shown) that directly contact the lower concrete surface to be finished. These engines require periodic servicing. Further, adequate high volume air flow is necessary for proper cooling.

Shroud 20 is disposed at the middle of the trowel between hoods 21 and 22. As best seen in FIGS. 2 and 5, shroud 20 preferably comprises a separate front plate 30, a spaced apart rear plate 32, and a planar, top plate 33 upon which seat 16 is mounted. Top 33 and front plate 30 are preferably formed from rigid, ten gauge metal. Rear plate 32 (FIG. 2) may be formed from rigid steel plate, but in the best mode steel mesh material of approximately ten or twelve gauge is preferred.

Shroud front plate 30 is generally rectangular. It comprises a plurality of louvers 34 for ventilation in combination with the shroud rear 32 and the hoods 21 and 22 to be described hereinafter. Plate 30 is releasably coupled to the trowel frame by a spring biased latch 36 (FIG. 2). Latch 36 extends from a latch mounting rail 35 secured to trowel frame 10. By lifting upwardly on the latch, prong portion 37 may be withdrawn from plate orifice 38 to free plate 30 for removal. As best seen in FIG. 3A, plate 30 has upper, rearwardly projecting tabs 40 adapted to be inserted into brackets 43. Alignment apertures 41 in tabs 40 register with bracket pins 42 when the plates are assembled.

Like front plate 30, shroud back plate 32 is generally rectangular. Is uppermost portion includes projecting, apertured mounting tabs 40A like tabs 40 previously described. These tabs secure the plate in place by mating with pills similar to pins 42. A central orifice 39A defined in plate 32 provides clearance for a water storage tank (not shown) which is part of the standard trowel spray system housed beneath shroud 20. Notches 39B defined in the bottom of late 32 provide clearance for exhaust pipes that run from the engines beneath the hoods 21, 22 to external mufflers 53. In some cases plate 32 may mount an electric fan 31 mounted to ring 31B (FIG. 3) for enhanced forced air ventilation. Alternatively, one or more suitable electric ventilation fans may be mounted to shroud front plate 30.

Plate 30 is preferably formed from rigid material equipped with suitable apertures or louvers for establishing airflow through the enclosed volume 15. Perforated steel plate or plate with adequate louvers may be used, but steel mesh material of approximately ten or twelve gauge is preferred. The preferred mesh construction establishes a positive airflow beneath shroud 20 within internal volume 15 to dissipate heat. Plate 32 is releasably coupled to the trowel by a spring biased latch 44 (FIG. 6) that is similar to latch 36 previously described. By lifting upwardly on the latch, prong portion 46 may be withdrawn from a suitable latching 3 orifice to free the plate for withdrawal.

The upper shroud plate 33 is preferably fixed to the subframe 10A (i.e., it is not field removable.) Arcuate terminal edges of plate 33 surmount the adjacent, transverse tube frame portions of subframe 10A (FIG. 2). Beneath plate 33 is an insulation layer 47 (FIG. 5) for thermally isolating the seat 16.

Figure 1:
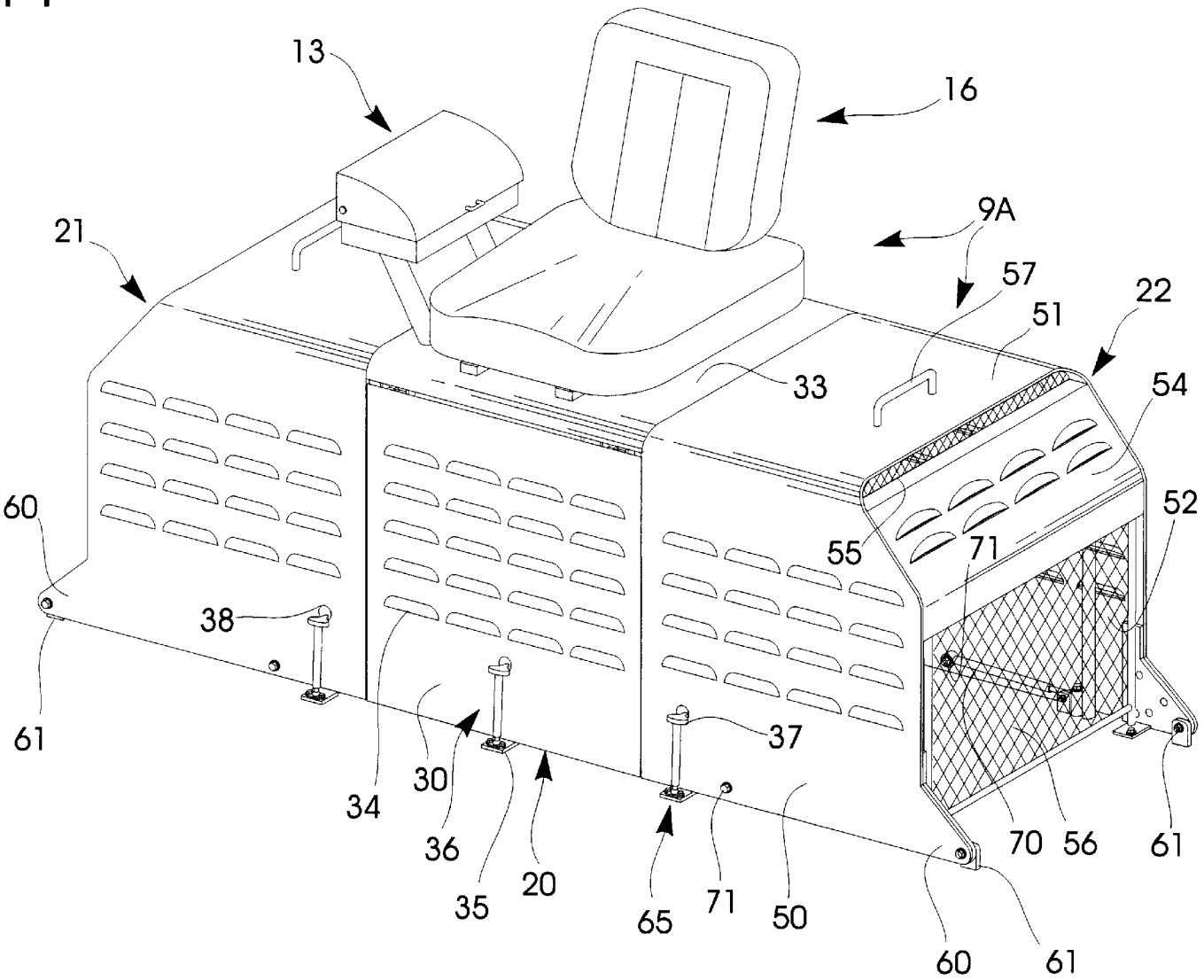
FIG. 1 is a fragmentary, front isometric view of the best mode of a riding trowel equipped with my shroud system, with portions omitted for clarity.

The hoods 21, 22 are disposed on opposite sides of the shroud 20. As these hoods are substantially similar, only one will be described in detail. Hood 22, for example, comprises a generally cubicle, metallic enclosure preferably formed from ten gauge steel. A front face 50 angularly is integral with a top portion 51 and a parallel, rear portion 52 (FIGS. 1, 2). A transverse shoulder portion 54 extends between plates 50 and 51, terminating adjacent a preferably mesh hood end 56. End 56 may comprise ten gauge steel mesh material. An upper ventilation slot 55 is preferably defined between top hood plate 51 and the upper edge of shoulder 54.

In trowel 9A the hoods are preferably hinged to the frame 10A. Suitable dogs 60 projecting from the hood front and back are hinged to the subframe at 61 (FIG. 1). A plurality of spaced apart ventilation louvers are preferably formed in front 50, rear 52, and shoulder 54. Latches 65 and 66 respectively secure the hood front 50 and rear 52. After the hood latches 65, 66 are manually released, the handle 57 may be manually grasped to deflect the hoods to the position illustrated in FIG. 2. Air cylinders 70 extend between the subframe 10A and a pivot point 71 near the bottom, inside of the front and back of the hood. The air cylinder elongates as the hood is folded outwardly, tending to brace and thus stabilize hood movement. With the hoods deflected outwardly (i.e., as viewed in FIG. 2) the motors (and other parts) are exposed for servicing. Additional access to critical parts is achieved by removing the shroud front and back previously described.

II. Alternative Embodiment

The alternative power riding trowel 9B of FIGS. 8–10 is similar to trowel 9A previously described. For ease of reading, the reference numerals used with this embodiment are the same as before for similar parts, except that the suffix "X" has been added to the previous reference numerals to indicate similar parts.

With attention now directed to FIGS. 8–10, trowel 9B comprises a frame 10X that supports an upper subframe 10AX similar to that previously described. The engine-surrounding volume 15X is enclosed by subframe 10AX, shroud 20X and deflectable hoods 21X, 22X. Shroud 20X at the middle of the trowel 9B is substantially the same as shroud 20 discussed in detail previously. The design of hoods 21X and 22X constitutes the primary difference between trowels 9A and 9B.

As before, hoods 21X, 22X are disposed on opposite sides of the shroud. Each hood 21X, 22X comprises a generally cubicle, metallic enclosure preferably formed from ten gauge steel. A front face 50X is integral with a top 51X and a parallel, rear portion 52X (FIG. 9). Transverse shoulder portion 54X terminates adjacent mesh hood end 56X. End 56X, which may comprise ten gauge steel mesh material, is preferably permanently attached to subframe 10X. An upper ventilation slot 55X is preferably defined between hood top 51X and the upper edge of hood shoulder 54X.

Hoods 21X, 22X are not hinged to the frame 10A. Instead latches 65X and 66X respectively secure the hood front 50X and rear 52X. After the hood latches 65X, 66X are manually released, the handle 57X may by grasped to lift the hoods away to the position illustrated in FIG. 9. At this time access to the engines is maximized.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For a motorized riding trowel comprising a rigid frame comprising a pair of spaced apart ends, a rotor at each end of said trowel for treating a concrete surface motor means secured to said frame for powering said rotors, a shroud system comprising:

a pair of protective hoods, each hood symmetrically associated with an end of said trowel, each hood comprising a generally vertically oriented front portion with a plurality of ventilation louvers and a generally horizontally oriented top portion, the top portion of each hood generally planar with the top portion of the other hood, wherein:

each hood selectively forms a separate, shrouded compartment; and, each hood is releasably latched to said frame for selectively covering or uncovering a rotor and, when coupled to the frame, establishing a positive airflow to dissipate heat;

a shroud in the middle of said trowel between the hoods, said shroud forming a compartment in between the hood compartments and comprising:

an upper, planar top surface that is substantially coplanar with the planar top portions of each hood;

a generally vertically oriented front portion which is generally coplanar with the hood front portions and which comprises a plurality of ventilation louvers for establishing a positive airflow to dissipate heat; and, means for at least temporarily latching said shroud, wherein the vertical oriented front portions of said hoods and said shroud are contiguous when said hoods are assembled in the closed postion to said frame; and, a seat for an operator disposed upon said planar upper surface of said shroud.

2. The shroud system as defined in claim 1 further comprising means for aligning said shroud when latched to said frame.

3. The shroud system as defined in claim 2 wherein each hood comprises a meshed end, and the shroud comprises a spaced-apart meshed back for enhancing ventilation.

4. The shroud system as defined in claim 1 wherein opposite outer ends of said hoods are hinged to said frame.

5. A motorized riding trowel comprising:

a rigid frame comprising a pair of spaced apart ends;

a rotor at each end of said trowel for treating a concrete surface;

motor means secured to said frame for powering said rotors;

a pair of protective hoods for shrouding the rotors, each hood symmetrically associated with an end of said trowel, each hood comprising a generally vertically oriented front portion with a plurality of ventilation louvers and a generally horizontally oriented top portion, the top portion of each hood generally planar with the top portion of the other hood, wherein:

each hood selectively forms a separate, shrouded compartment; and, each hood is releasably latched to said frame for selectively covering or uncovering a rotor and, when coupled to the frame, establishing a positive airflow to dissipate heat;

a shroud in the middle of said trowel between the hoods, said shroud forming a compartment in between the hood compartments and comprising:

an upper, planar top surface that is substantially coplanar with the planar top portions of each hood;

a generally vertically oriented front portion which is generally coplanar with the hood front portions and which comprises a plurality of ventilation louvers for establishing a positive airflow to dissipate heat; and, means for at least temporarily latching said shroud to said frame; and, a seat for an operator disposed upon said planar upper surface of said shroud, wherein the vertical oriented front portions of said hoods and said shroud are contiguous when said hood are assembled in the closed postion.

6. The trowel as defined in claim 5 further comprising means for aligning said shroud with respect to said hoods, when latched to said frame.

7. The trowel as defined in claim 6 wherein each hood comprises a meshed end, and the shroud comprises a spaced-apart meshed back for enhancing ventilation.

8. The trowel as defined in claim 5 wherein opposite outer ends of said hood are hinged to said frame, and said hoods comprise handles for manually pivoting them about the hinges.

9. A motorized riding trowel comprising:

a rigid frame comprising a pair of spaced apart ends, the frame adapted to support rotor means at each end of said trowel for treating a concrete surface;

motor means secured to said frame at each end for powering said rotor means;

a pair of protective hoods for shrouding the motors, each hood symmetrically associated with an end of said trowel, each hood comprising a generally vertically oriented front portion with a plurality of ventilation louvers, a spaced-apart, generally vertically oriented rear portion with a plurality of ventilation louvers, and a generally horizontally oriented top portion extending between the front and rear portions, the top portion of each hood generally planar with the top portion of the other hood, wherein:

each hood selectively forms a separate, shrouded compartment enclosing a motor; and, each hood is releasably latched to said frame for selectively covering or uncovering a motor, and, when coupled to the frame, establishing a positive airflow to dissipate heat;

a shroud in the middle of said trowel between the hoods, said shroud forming a compartment in between the hood compartments and comprising:

an upper, planar top surface that is substantially coplanar with the planar top portions of each hood;

a generally vertically oriented front portion which is generally coplanar with the hood front portions and which comprises a plurality of ventilation louvers for establishing a positive airflow to dissipate heat; and, means for at least temporarily latching said shroud to said frame; and, a seat for an operator disposed upon said planar upper surface of said shroud, wherein the vertical oriented front portions of said hoods and said shroud are contiguous when said hoods are assembled in the closed postions.

10. The trowel as defined in claim 9 further comprising means for aligning said shroud with respect to said hoods, when latched to said frame.

11. The trowel as defined in claim 10 wherein each hood comprises a meshed end, and the shroud comprises a spaced-apart meshed back for enhancing ventilation.

12. The trowel as defined in claim 9 wherein opposite outer ends of said hoods are hinged to said frame.

* * * * *